United States Patent [19]

Gabus

[11] 4,118,612

[45] Oct. 3, 1978

[54] ACTUATING DEVICE FOR AN INVALID OF PLURAL ELECTRICAL CONTROL CIRCUITS

[75] Inventor: Jean-Claude Gabus, Hauterive, Switzerland

[73] Assignee: Carba S.A., Berne, Switzerland

[21] Appl. No.: 787,921

[22] Filed: Apr. 15, 1977

[30] Foreign Application Priority Data

May 7, 1976 [CH] Switzerland ..... 5729/76

[51] Int. Cl.[2] ..... H01H 35/34

[52] U.S. Cl. ..... 200/81.9 R; 200/81.4; 200/83 N; 137/595

[58] Field of Search ..... 251/25; 137/595, 596.14; 200/81 H, 81.4, 81.5, 81.9 R, 83 R, 83 N, 83 Q, 83 T, 83 Y, 83 Z; 340/240

[56] References Cited

U.S. PATENT DOCUMENTS

| | | | |
|---|---|---|---|
| 2,805,679 | 9/1957 | Schrameck | 200/81.4 |
| 3,256,045 | 6/1966 | Stelzer | 200/81.9 R |
| 3,784,153 | 1/1974 | Ross | 251/25 |
| 3,814,877 | 6/1974 | Alvarez | 200/81.9 R |
| 3,842,224 | 10/1974 | Weis | 200/81.9 R |
| 3,952,284 | 4/1976 | Martin | 200/81.4 |

FOREIGN PATENT DOCUMENTS 381,531 10/1964 Switzerland.

*Primary Examiner*—Gerald P. Tolin
*Attorney, Agent, or Firm*—Young & Thompson

[57] ABSTRACT

The invention relates to an actuating device for an invalid of at least one electrical control circuit of an apparatus comprising a source of a fluid with a constant flow which is feeding at least a pipe with an open end and a branch, said branch feeding a pressure detector which controls, when said open end is closed, the switching on or switching off of an utilization circuit.

4 Claims, 2 Drawing Figures

ACTUATING DEVICE FOR AN INVALID OF PLURAL ELECTRICAL CONTROL CIRCUITS

The present invention relates to an actuating device for an invalid of at least one electrical control circuit of an apparatus, for example an alarm, a light, a radio or T.V. apparatus, devices for turning the pages of a book or for opening a door, etc.

Apparatus to be used by invalids are already known, which must be provided with appropriate control devices able to be actuated by said invalids despite their infirmity.

The purpose of this invention is consequently to provide a control device which can be actuated especially by invalids who are only able to realize motions of small amplitude but with a relatively good precision, which only requires from the user the application of a very weak strength and which does not involve any direct electrical contact with the utilization circuit.

The control device according to this invention and intended to reach the above-mentioned purpose is characterized in that it comprises a source of a fluid with a constant flow which is feeding at least a pipe with an open end and a branch, said branch feeding a pressure detector which controls, when said open end is closed, the switching on or switching off of a utilization circuit.

The annexed drawing illustrates schematically and by way of example two embodiments of the actuating device according to the invention.

Figure 1:
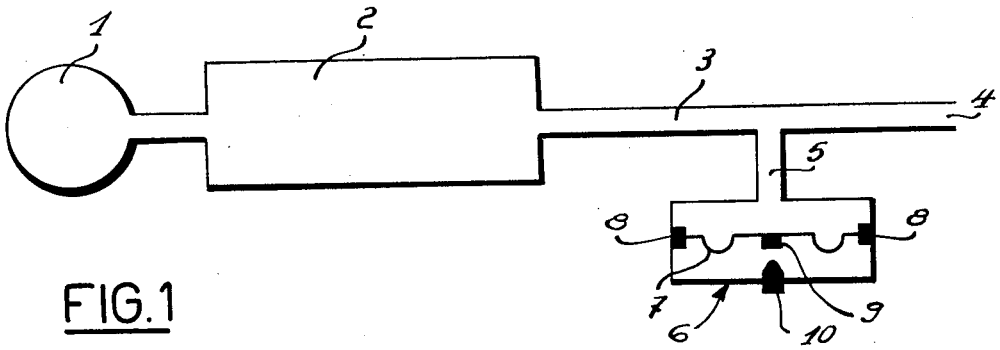
FIG. 1 is a view of a first embodiment having a single control member.

Referring first to FIG. 1, the control device according to the invention comprises a pump 1, for example a membrane force-pump, which is connected to a buffer reservoir 2, this latter being intended to absorb the variations of the flow of the compressed fluid, here the air, said variations being caused by the force-pump. Said pump 1 and said reservoir 2 are constituting a source of fluid with a constant flow, said flow being preferably very low.

This source of fluid is feeding a pipe 3 comprising an open end 4 and a branch 5, said branch being connected to a pressure detector 6.

The pressure detector 6 comprises in this embodiment a membrane 7, which is very sensitive to the variations of pressure; each end of said membrane is provided with a fixed contact member 8 being connected to an electrical utilization circuit, and the central portion of said membrane carrying a moving contact member 9.

When the open end 4 of the pipe 3 is closed by any means, then the pressure of the fluid increases, thereby modifying the form of the membrane 7 in such a manner that said moving contact member 9 is coming into contact with a fixed contact member 10, with which the external wall of the detector 6 is provided, in order to switch on or to switch off the electrical utilization circuit, to which said contact member 10 is connected.

Figure 2:
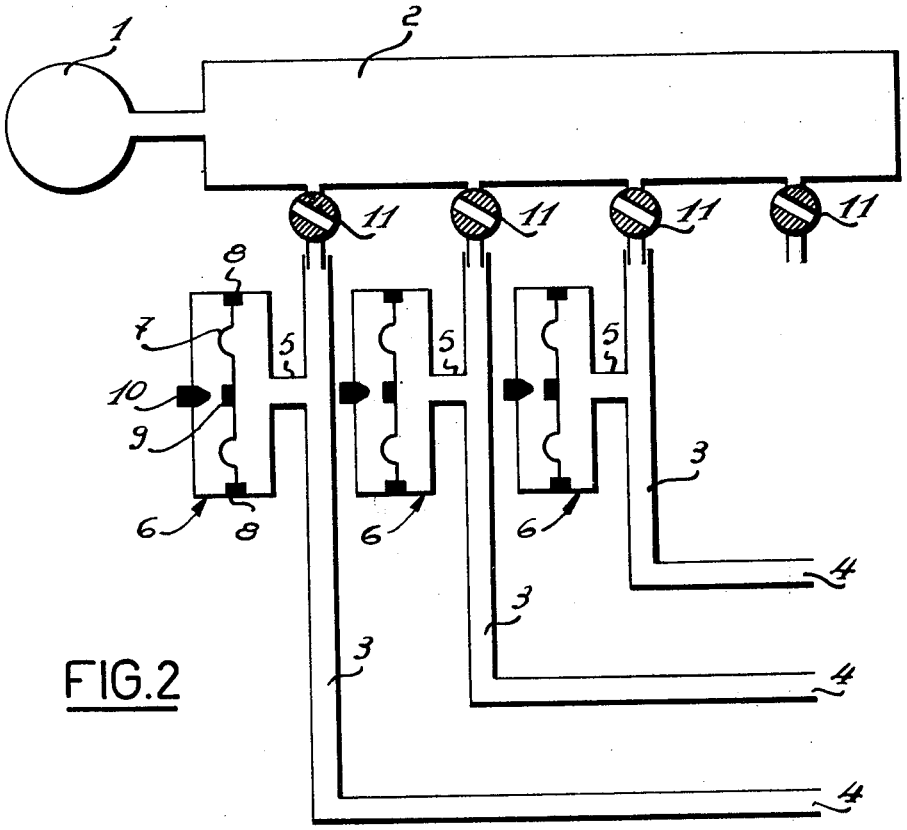
FIG. 2 is a view of a second embodiment having a plurality of control members.

Referring now to FIG. 2, in which the same reference ciphers are corresponding to the same members described above with regards to FIG. 1, the device according to the invention comprises several feeding outlets (here four) each provided with an adjusting valve 11 of the flow of the fluid, from a single source of fluid comprising a pump 1 and a buffer reservoir 2.

The working operation of this second embodiment is the same as that of the first embodiment, but this second embodiment allows one to control several utilization circuits (here three) by employing a single source of fluid. The adjusting valve 11, located up-stream the branch 5 feeding the detector 6, is useful for decreasing the flow of the compressed fluid, in such a manner that when the open end 4 of one pipe 3 is closed, the pressure variation does not at all act on the detectors connected to the other pipes. The flow adjustment is carried out according to the number of pipes 3 which are connected to the same source 2 and according to the total flow supplied by said source.

Furthermore, the pipe 3 can be made of a flexible material, and its length is in principle not limited. This therefore allows the control at a distance of one or several utilization circuits, the distance between the circuit(s) of use and the source of fluid being also in principle not limited.

It is consequently possible to utilize the device according to the invention for controlling at a distance a circuit of use located in an explosive medium for example.

This control device is particularly convenient to be used by invalids, for example paralytics, because its actuation does not require the application of a too important strength to be exerted with the member or the part of the body of the user which is employed to close the open end of the pipe. The control of the switching off or the switching on of the utilization circuit can be therefore easily realized for example with a finger, the palm or the back of the hand, the tongue, the mouth, or any other part of the body, the motion of which can be secured for closing said open end of a pipe.

Furthermore, the device according to the invention is completely safe for users such as invalids, since it cannot be upset or damaged by a badly directed or unintentional movement thereof and since it does not involve any direct contact between the users and the electrical circuit of the controlled apparatus.

Finally, the actuating device according to the invention is further advantageous in that it is very cheap, since in its manufacture one can employ for example membrane pumps and membrane detectors easily commercially available and at low prices.

Of course, it is however to be noted that, in other embodiments of the control device according to the invention, a non forcing pump can be utilized for directly supplying with a constant flow of fluid, this avoiding the use of a buffer reservoir, and that the pressure detector and its connection arrangement to the circuit can be of any other nature, the membrane detector being also able to be replaced for example by a spiral detector.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What I claim is:

1. An actuating device for an invalid of plural electrical control circuits, comprising a source of air under pressure, a buffer reservoir that receives and stores said air from said source, a plurality of conduits separately and directly communicating with said reservoir, each said conduit having an open end, said open ends of said conduits being spaced apart and said conduits providing normally open passageways for the continuous flow of air from said reservoir through said conduits and out said open ends along a plurality of separate paths, a separate membrane for each said conduit, said membrane being exposed on one side to the air in its associated said conduit between its open end and said reservoir, and separate electrical contact means associated with each said membrane for opening or closing an electrical control circuit upon movement of said membrane when the pressure of the air on said one said of said membrane increases as a result of an invalid closing said open end of the associated said conduit, whereby an invalid can select a said circuit to open or close by selecting a said open end to close.

2. An actuating device as claimed in claim 1, and means restricting the flow of air from said reservoir into each said conduit.

3. An actuating device as claimed in claim 2, said restricting means comprising a valve individual to each said conduit.

4. An actuating device as claimed in claim 1, said source of air under pressure comprising a membrane pump.

* * * * *